US009151140B2

(12) United States Patent
Hummes et al.

(10) Patent No.: US 9,151,140 B2
(45) Date of Patent: Oct. 6, 2015

(54) DOWNHOLE TOOLS WITH ELECTRO-MECHANICAL AND ELECTRO-HYDRAULIC DRIVES

(75) Inventors: Olof Hummes, Wadersloh (DE); Michael Koppe, Lachendorf (DE); Volker Krueger, Celle (DE); Sven Krueger, Winsen (DE); Matthias Meister, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 874 days.

(21) Appl. No.: 12/975,557

(22) Filed: Dec. 22, 2010

(65) Prior Publication Data

US 2011/0147086 A1 Jun. 23, 2011

Related U.S. Application Data

(60) Provisional application No. 61/289,674, filed on Dec. 23, 2009.

(51) Int. Cl.

| | |
|---|---|
| ***E21B 7/00*** | (2006.01) |
| ***E21B 4/00*** | (2006.01) |
| ***E21B 41/00*** | (2006.01) |
| *E21B 23/00* | (2006.01) |

(52) U.S. Cl.

CPC ..... *E21B 41/00* (2013.01); *E21B 23/00* (2013.01); *E21B 2023/008* (2013.01)

(58) Field of Classification Search

CPC .... E21B 41/00; E21B 2023/008; E21B 23/00
USPC ..... 166/65.1, 66.5, 66, 6, 381, 217, 50, 166/66.6; 175/61, 106, 76, 99, 57, 92; 310/87, 26, 306, 309, 311; 318/264–266, 272, 275, 277, 282, 286, 318/466–469, 626; 335/215

See application file for complete search history.

(56) References Cited

U.S. PATENT DOCUMENTS

| | | | | |
|---|---|---|---|---|
| 5,270,595 | A | 12/1993 | Wisner | |
| 5,726,520 | A * | 3/1998 | Grahn | 310/328 |
| 6,026,847 | A * | 2/2000 | Reinicke et al. | 137/487.5 |
| 7,035,056 | B2 | 4/2006 | Franken et al. | |
| 7,503,756 | B2 * | 3/2009 | Dooley | 417/322 |
| 7,675,253 | B2 * | 3/2010 | Dorel | 318/118 |

(Continued)

FOREIGN PATENT DOCUMENTS

| | | |
|---|---|---|
| GB | 2443912 A | 5/2008 |
| WO | 9726090 A1 | 7/1997 |

OTHER PUBLICATIONS

International Preliminary Report on Patentability dated Jul. 5, 2012 for International Application No. PCT/US2010/061877.

(Continued)

*Primary Examiner* — Jennifer H Gay
*Assistant Examiner* — George Gray
(74) *Attorney, Agent, or Firm* — Cantor Colburn LLP

(57) ABSTRACT

An apparatus to be conveyed into a wellbore. The apparatus includes a housing configured to be conveyed downhole and a drive member located in the housing. The apparatus further includes a drive unit configured to actuate movement of the drive member by selectively coupling to the drive member, wherein the coupling of the device to the drive member is controlled by applying an energy to a selected material in the device.

21 Claims, 5 Drawing Sheets

(56) References Cited

U.S. PATENT DOCUMENTS

| | | | | |
|---|---|---|---|---|
| 7,999,422 | B2 | 8/2011 | Dorel | |
| 2002/0023759 | A1 * | 2/2002 | Deaton | 166/381 |
| 2006/0198742 | A1 | 9/2006 | DiFoggio et al. | |
| 2008/0000693 | A1 * | 1/2008 | Hutton | 175/61 |
| 2008/0053705 | A1 | 3/2008 | Aronstam et al. | |
| 2008/0111431 | A1 | 5/2008 | Dorel | |
| 2011/0127085 | A1 * | 6/2011 | Partouche | 175/57 |

OTHER PUBLICATIONS

EPO extended European search report; Application No. 10840136.5; Date of Mailing Apr. 2, 2015; pp. 1-6.

* cited by examiner

DOWNHOLE TOOLS WITH ELECTRO-MECHANICAL AND ELECTRO-HYDRAULIC DRIVES

CROSS REFERENCES TO RELATED APPLICATIONS

This application claims priority from the U.S. Provisional Patent Application having Ser. No. 61/289,674 filed Dec. 23, 2009

BACKGROUND OF THE DISCLOSURE

1. Field of the Disclosure

The disclosure relates generally to drive units or devices for use in downhole tools.

2. Description of the Related Art

Oil wells (also referred to as "wellbores" or "boreholes") are drilled with a drill string that includes a tubular member having a drilling assembly (also referred to as the "bottom-hole assembly" or "BHA") at an end of the tubular member. The BHA typically includes a variety of tools and sensors that provide information relating to a variety of parameters relating to drilling operations ("drilling parameters"), behavior of the BHA ("BHA parameters"), and parameters relating to the formation surrounding the wellbore ("formation parameters"). A large number of wellbores include curved sections. A BHA used to drill non-vertical sections of the borehole often includes a steering unit to steer the drill bit along a desired direction. One type of steering unit includes a number of force application members that are moved radially outward to apply pressure on the borehole wall. A drive unit or an actuator is used to move the force application member. Formation evaluation tools used in both a BHA and in wireline tools utilize devices that include a drive unit to operate a piston to drawdown fluid from the formation. Other tools used in BHA and wireline logging tools also utilize drive units in conjunction with other devices to extract fluid from the formation for testing and analysis of the extracted fluids. Other devices in downhole tools that utilize drive units may include valves, pistons and the like. Moveable stabilizer blades, bit controllers, coring tools, mud pulse tools, and other moving components may also be configured to use drive units.

Drive units used for expanding force application members typically incorporate motor driven piston pumps that provide pressurized fluid to expand or move a piston. The pressure level is controlled by a nozzle arrangement in conjunction with pump rotational speed or torque or by a solenoid proportional valve. Certain other drive units are based on a motor-driven ball screw spindle, driving a first piston of smaller diameter to provide pressure to a larger secondary piston.

Such drive units are relatively mechanically complex and also utilize filters, flow restrictors, shut-off valves, etc. for fail-safe operations and pressure relief valves for overload protection. The complexity and components of these drive units may require frequent maintenance and be costly to manufacture. The disclosure herein provides drive units that are relatively small and address some of the above-noted problems.

SUMMARY

In one aspect, an apparatus to be conveyed into a wellbore is provided, wherein the apparatus includes a housing configured to be conveyed downhole and a drive member located in the housing. The apparatus further includes a drive unit configured to actuate movement of the drive member by selectively coupling to the drive member, wherein the coupling of the device to the drive member is controlled by applying an energy to a selected material in the device.

In another aspect, an apparatus conveyed into a well borehole for conducting a downhole operation is provided. The apparatus includes a mechanically-actuated device adapted for conveyance by a work string, the mechanically-actuated device being used at least in part for conducting the downhole operation and a magnetostrictive linear actuator coupled to the mechanically-actuated device for selectively actuating the mechanically-actuated device. In addition, the magnetostrictive linear actuator includes a support structure to compensate for a borehole parameter.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DESCRIPTION OF THE DISCLOSURE

Figure 1:
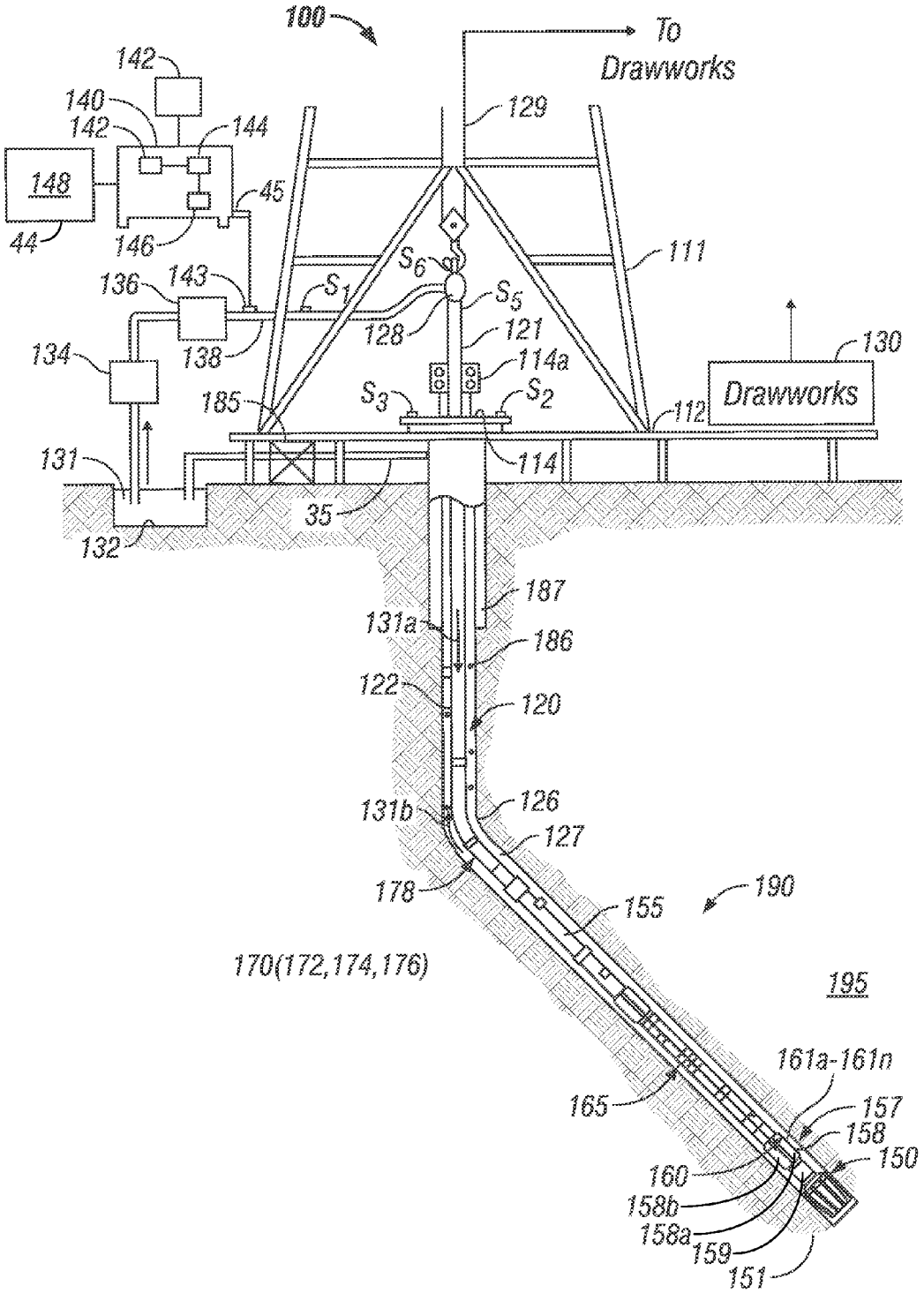
FIG. 1 is an elevation view of a drilling system including a downhole tool according to an embodiment of the present disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottom-hole assembly ("BHA") 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190 attached at its bottom end extends from the surface to the bottom 151 of the borehole 126. A drill bit 150, attached to drilling assembly 190, disintegrates the geological formations when it is rotated to drill the borehole 26. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The ROP for a given BHA largely depends on the WOB or the thrust force on the drill bit 150 and its rotational speed. The mud motor 155 is coupled to the drill bit 150 via a drive shaft disposed in a bearing assembly 157. The mud motor 155 rotates the drill bit 150 when the drilling fluid 131 passes through the mud motor 155 under pressure. The bearing assembly 157, in one aspect, supports the radial and axial forces of the drill bit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices.

The BHA may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, properties or characteristics of the fluids downhole and determine other selected properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. For convenience, all such sensors are denoted by numeral 159.

Figure 2:
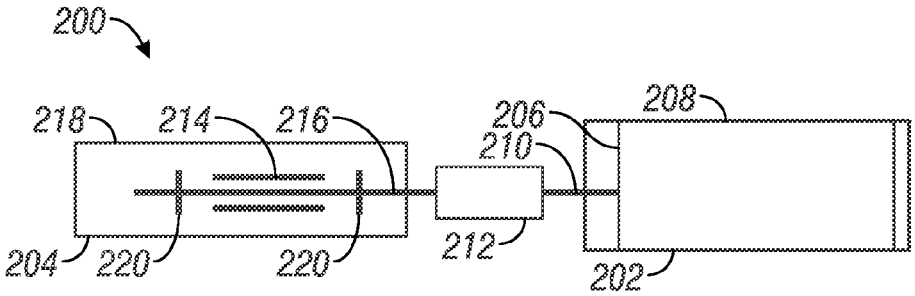
FIGS. 2-4 show a downhole tool according to several embodiments of the present disclosure.
Figure 3:
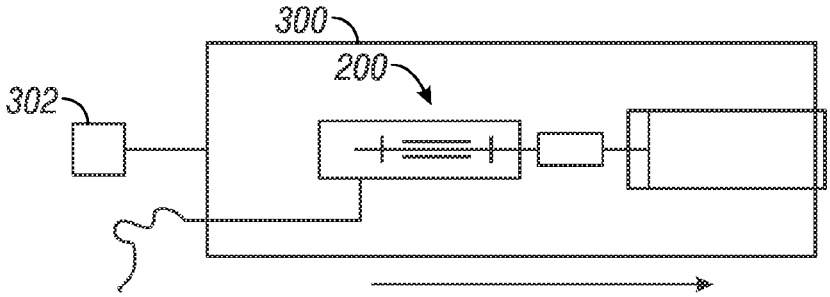
Figure 4:
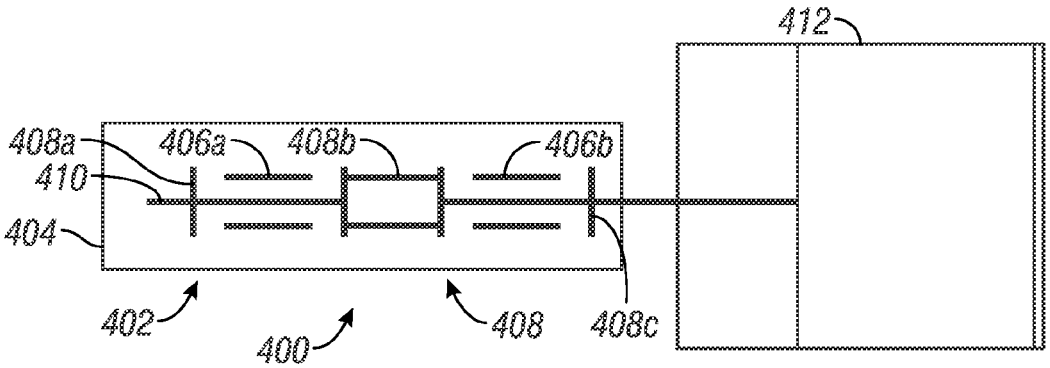

The drilling assembly 190 includes a steering apparatus or tool 158 for steering the drill bit 150 along a desired drilling path. In one aspect, the steering apparatus may include a steering unit 160, having a number of force application members 161*a*-161*n*, each such force application unit operated by drive unit or tool made according to one embodiment of the disclosure. A drive unit is used to operate or move each force application member. A variety of wireline tools (not shown) used for logging well parameters subsequent to drilling include formation testing tools that utilize drive units to move a particular device of interest. Various exemplary embodiments drive units made according to this disclosure are described below in reference to FIGS. 2-8. FIGS. 2-4 schematically show a downhole tool according to several embodiments of the present disclosure. FIG. 2 illustrates a tool 200 that includes a mechanically-actuated device 202. The mechanically-actuated device 202 is actuated using a linear magnetostrictive actuator 204. A linear magnetostrictive actuator provides the benefits of small size, high actuation force and controllability. The device mechanically-actuated device 202 described and shown is a drawdown tool for exemplary purposes only. Any mechanically-actuated tool is considered within the scope of the disclosure. As used herein, the term magnetostrictive actuator means any of a number of actuators using materials exhibiting magnetostrictive properties for an actuating element. The term ferromagnetic material used herein is used as an exemplary material for a magnetostrictive actuator without the exclusion of other materials exhibiting magnetostrictive properties used as an actuating element. A magnetostrictive actuator according to the present disclosure is intended to include any such actuator using any such material exhibiting magnetostrictive properties as an actuating element.

A piston 206 is shown movably housed in a piston cylinder 208. A piston rod 210 is coupled to one end of the piston 206, and the piston rod 210 passes through the piston cylinder 208. The piston rod 210 is translated along its longitudinal axis by the magnetostrictive linear actuator 206. An optional stroke multiplier 212 may be coupled to the piston rod 210 to increase the stroke of the piston rod 210. In one aspect, the magnetostrictive linear actuator 204 includes a coil 214 disposed around a magnetostrictive rod 216. The rod 216 comprises a ferromagnetic material exhibiting magnetostrictive properties. One such material is sold under the trade name "Terfenol-D." Such a material changes shape when exposed to a magnetic field and has been found to be useful for downhole applications. Nickel, cobalt, steel, alloys, and any other suitable material may also be utilized as magnetostrictive materials for the purposes of this disclosure. A support structure 218 includes one or more clamping devices 220 for holding a portion of the magnetostrictive rod 216 in place while an applied magnetic field causes an elongation of the ferromagnetic rod material. The support structure 218 supports the rod 216 and coil 214. In aspects of the disclosure, the coil 214 forms a portion of the support structure.

In some actuators, the clamping device may include a controllable clamp. Such a controllable clamp may be a pair of controllable clamps. In operation, a first clamp is activated to hold a portion of the rod 216 while a second clamp is activated to release a second portion of the rod 216. When a magnetic field is applied, the rod 216 elongates through the released clamp. Then, the released clamp is activated to clamp the rod and the first clamp is released. Then the magnetic field is discontinued to allow the first clamped rod portion to move toward the second clamp. This series of actions result in a linear "crawl" of the rod through the actuator.

In other actuators, the clamping device may be a tube through which a magnetostrictive rod passes. The outer rod diameter and tube inner diameter are such that the rod tightly fits within the tube when no magnetic field is applied. A magnetic field is controllably applied along the rod such that a portion of the rod elongates. The elongated rod portion necessarily reduces in diameter and thus extends through the tube while the rod portion without an applied magnetic field remains "clamped" within the tube due to the close tolerance of outer rod diameter to inner tube diameter. As the field passes along the tube, the previously elongated portion resumes its original shape and tight fit within the tube. At the same time, other portions of the rod are undergoing the field-elongation phase of movement. This series of actions results in the rod "crawling" along the tube in a linear fashion.

A downhole environment is typically harsh and some cases the temperature may reach 175 degrees centigrade. Magnetostrictive drive units may not properly operate at such high temperatures. One cause of such inoperability may be that the magnetostrictive rod and support structure clamping mechanism have differing thermal expansion characteristics.

FIG. 3 illustrates an embodiment of a drive unit wherein a tool 200, substantially as described above and shown in FIG. 2, is housed within a linearly-extendable housing 300. The housing 300 may be extended by conventional hydraulic or electromechanical devices 302, or the housing 300 may be extended by the use of a separate magnetostrictive linear actuator according to the present disclosure. Such a configuration extends the overall linear movement of the tool 200. Where the tool includes a fluid drawdown device, larger borehole size can be accommodated.

FIG. 4 illustrates a tool 400 that includes a magnetostrictive actuator 402 and a support structure 404. The actuator 402 includes a first coil 406*a* and a second coil 406*b*. A clamping device 408 includes a first clamp 408*a*, a second clamp 408*b* and a third clamp 408*c*. The second clamp 408*b* includes a center portion made of non-ferromagnetic material through which a magnetostrictive rod 410 passes. The clamps and coils operate substantially as described above to provide linear movement of the rod 410. The coil pair 406*a*, 406*b* and clamps 408*a*, 408*b* and 408*c* provide extended stroke for the magnetostrictive rod. The linear actuator is used to actuate a downhole device 412, which may be a formation fluid drawdown device as described above.

In any of the above embodiments, the support structure and magnetostrictive member may be selected to achieve the desired operation even within an extreme borehole environment. In some embodiments, the support structure may be selected from materials having thermal expansion characteristics substantially equivalent to the thermal expansion characteristics of the ferromagnetic material used within the actuator. The support structure may include a ceramic material. In other embodiments, the support structure may include cooling devices or a member to counter the high temperature environment of boreholes.

Figure 5:
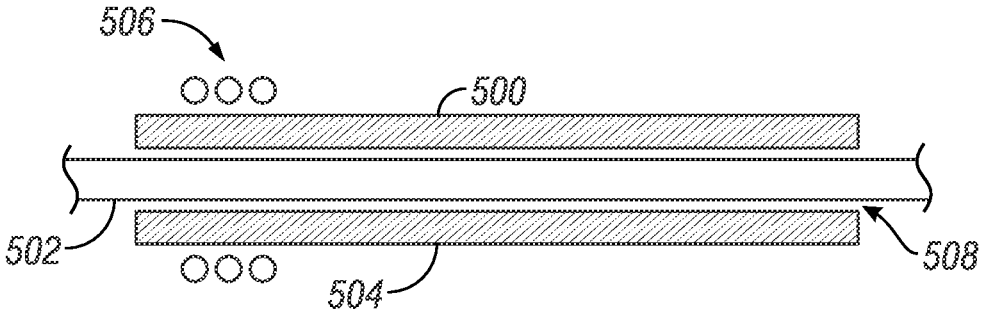
FIG. 5 is a cross-section to illustrate embodiments of the present disclosure utilizing matched material characteristics.

FIG. 5 is a cross section of a portion of a magnetostrictive actuator according to one embodiment of the present disclosure. The actuator 500 includes a ferromagnetic rod 502 passing through a support structure clamping device 504. A current-carrying coil 506 causes elongation of the rod 502. The elongated rod creates a small gap 508 between the rod 502 and clamping device 504. The clamping device 504 may be one of a plurality of controllable clamping devices being electrically controlled to create the gap 508. In the embodiment of FIG. 5, the support structure clamping device 504 may be made using a material having coefficient of thermal expansion ("CTE") that matches the CTE of the ferromagnetic rod 502 (For example, an actuator 500 using a rod having a CTE of about 12 ppm/° C. will further include a support structure 504 manufactured using a low alloy steel having a CTE of about 11 to 12 ppm/° C.). Depending upon the selected ferromagnetic material, the support structure 504 may be made using any number of alloys so long as the CTE of the support structure material matches or substantially matches the CTE of the ferromagnetic material.

Figure 6:
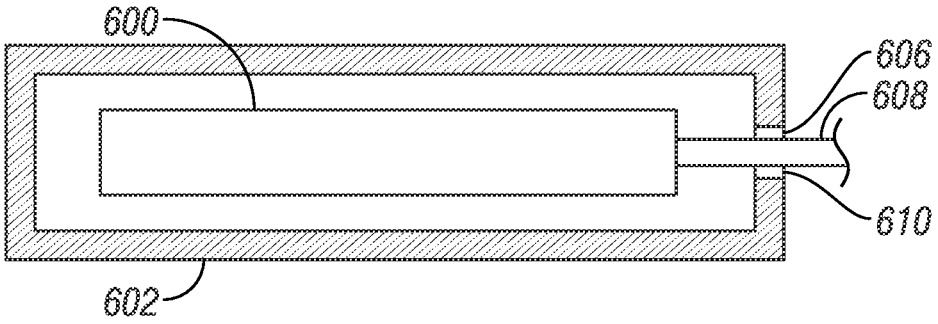
FIG. 6 is a cross-section to illustrate embodiments of the present disclosure utilizing active cooling and/or Dewars canisters.

Alternatively, the support structure may include cooling elements (passive or active) to reduce the environmental temperature around the actuator. An embodiment of the present disclosure utilizing cooling is shown in FIG. 6. Shown is a magnetostrictive actuator 600 housed within a cooling device 602. The cooling device may be a Dewars cooling canister or flask having a port 606 through which an actuating rod 608 passes. An insulating o-ring seal 610 positioned at the port 606 between the rod 608 and cooling device 602 allows the rod to move linearly while maintaining a stable temperature within the local environment of the actuator 600. The rod 608 is used to actuate a mechanically operated tool as describe above.

Alternatively, the cooling device 602 may be an active cooling element such as a thermoelectric element. In either case, the cooling device 602 creates a local temperature environment for the actuator 600. The local temperature environment may be established at a much lower temperature than the borehole temperature, thus allowing for a better operation of the actuator 600. In one aspect, the local temperature environment may be maintained below the Curie temperature of the magnetostrictive material used in the actuator. In one aspect, the local temperature environment may be maintained below a predetermined temperature, the predetermined temperature being determined in part by the CTE of the support structure and the CTE of the magnetostrictive material supported by such support structure.

Figure 7:
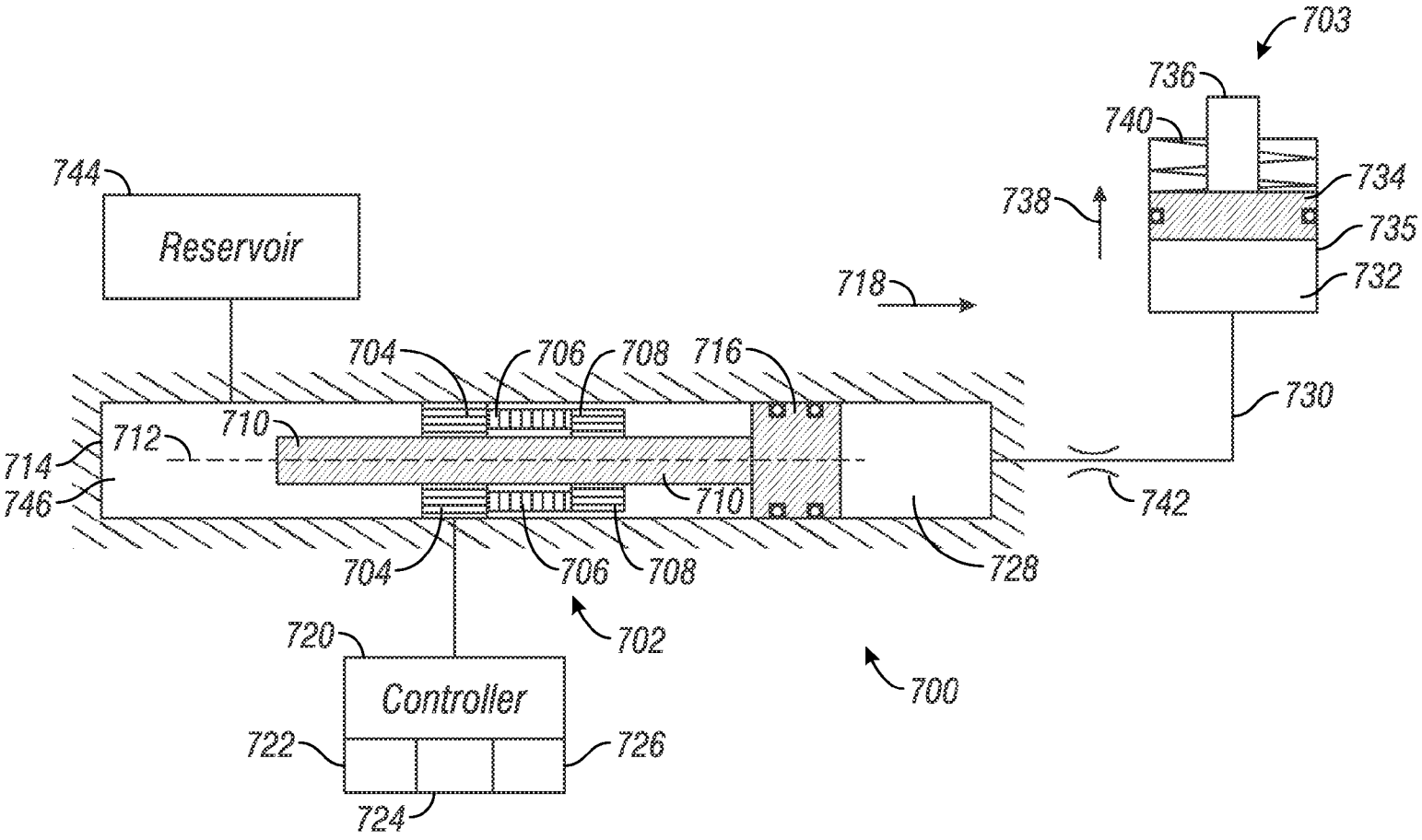
FIG. 7 is a cross-section schematic illustrating an embodiment of an electro-hydraulic drive system, according to one embodiment of the disclosure.

FIG. 7 is a sectional schematic view of an exemplary embodiment of an electro-hydraulic drive unit or system 700 for use in downhole applications. The drive system 700 includes an electromechanical drive unit 702 and secondary drive unit 703. In an aspect, the electromechanical drive unit 702 controls flow of hydraulic fluid to the secondary drive unit 703, thereby providing drive system 700 to move components in a downhole tool. The electromechanical drive unit 702 utilizes piezoelectric members 704, 706 and 708 configured to expand when activated (when electrical energy is applied to them) and contract when deactivated (the applied electrical energy is removed from them). In one aspect, the piezoelectric members may include piezoelectric stacks. The member 704 is coupled to inside of the chamber 714, member 706 is coupled to the member 704 and member 708 is coupled to member 706. The members 704 and 708 are positioned to grip or clamp a drive member or rod 710, while member 706, positioned between the members 704 and 708, is positioned to drive or move the member 708 along direction 718. The drive member 710 may be moved axially 712 within a housing 714 to cause movement of a piston 716 in the direction 718.

In the configuration shown in FIG. 7, when the member 708 is clamping the member 710, a movement of piezoelectric member 706 in the direction 718 will cause the piston 716 to move in direction 718, thereby reducing a volume 728 within the housing 714. A fluid, such as hydraulic fluid, is pressed out of fluid volume 728 and through conduit 730 into a fluid volume 732, causing piston 734 to move in the direction 738. The fluid displaces the piston 734, located in a second housing 735, causing a drive member 736 to move in direction 738. In aspects, the fluid movement into volume 732 overcomes the force generated by a biasing member 740 to resist movement in direction 738. A flow restrictor, such as a nozzle 742, may be located in the conduit 730 to regulate movement and control backflow of the fluid 732 into fluid volume 728. As depicted, the drive system 700 may be referred to as a sealed or closed loop system with respect to the flow of fluid used to drive members.

In addition, the drive system 700 may include a compensation reservoir 744 to adjust for volume changes in volume 746 caused by the movement of piston 716. In an aspect, the piston 716 may be sealed within the housing 714 and coupled to the drive member 710, wherein the drive member 710 and piston 716 are composed of a suitable rigid and durable material, such as a stainless steel or steel alloy. In one aspect, the drive member 710 is held in position by piezoelectric members 704, 706 and 708. The piezoelectric members 704, 706 and 708 include a material that expands or contracts based on exposure to an electric field. As depicted, the piezoelectric members 704 are coupled to the inner surface of the housing 714. The members 706 are coupled to the members 704 and 708. The piezoelectric members 704, 706 and 708 may each be composed of stacks of piezoelectric material, wherein the stacks are oriented to expand and contract in selected directions. In an aspect, the members 704 and 708 are configured to expand and contract in a direction generally radial or perpendicular to the axis 712. The members 706 are configured to expand and contract in a direction generally parallel to axis 712. Although the system 700 is described using piezoelectric members, such members may be made from any other suitable material that may be expanded and contracted as desired. For example, any material that expands or contracts in response to an energy source may be used. In one aspect, magnetostrictive materials may be used, wherein the material is capable of converting magnetic energy into kinetic energy.

A controller 720 may be used to control movement of piezoelectric member 708. The controller 720 includes a processor 722, memory 724 and programs 726 used to control movement (expansion and contraction) of the piezoelectric members 704, 706 to operate the electromechanical device 702. In another aspect, a programmed microcontroller may be used as the controller 720. The controller is configured to selectively produce an electric field in the piezoelectric members 704, 706 and 708. In an embodiment, the drive system 700 may utilize the electromechanical drive unit 702 to directly control movement of a component of a downhole tool.

Figure 8:
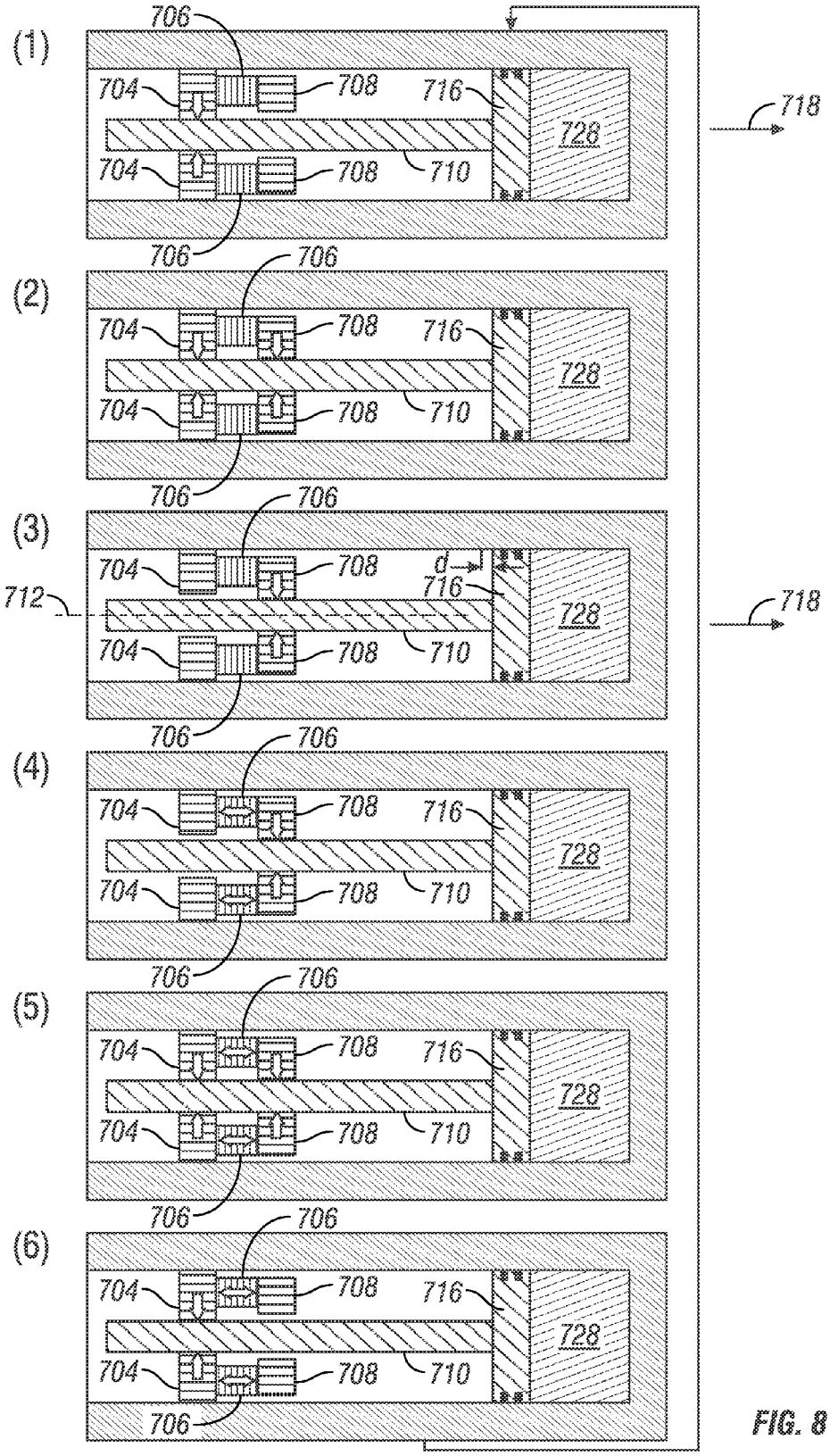
FIG. 8 shows a sequence of operations for the electro-hydraulic drive system shown in FIG. 7.

The operation of the drive unit 702 is described in reference to FIGS. 7 and 8. In one aspect, to move the piston 716 forward (in the direction 718), the procedure may include: energize (radially expand) member 704 to hold drive member 710 (FIGS. 8, 1); energize (radially expand) member 708 to hold drive member 710 (FIGS. 8, 2); de-energize (release) member 704 from the member 710 (FIGS. 8, 3); and energize (linearly expand) member 706 to linearly move the member 710 in the direction 718 by an amount "d" (FIGS. 8, 4). The movement of the drive member 710 moves the piston 716 by a distance "d." To move the piston 716 by another distance: activate (expand) member 704 (FIGS. 8, 5) to hold drive member 710; deactivate (contract) member 708 to release drive member 710 (FIGS. 8, 6); deactivate (contract) member 706 to bring it to its original position (FIGS. 8, 1); and then repeat the steps shown in FIGS. 8, 2-8, 4. The movement of the piston 716 discharges a certain amount of fluid from chamber 728 into the chamber 732, which drives the piston 734, which in turn may move a member 736. The member 736 may then perform a desired function, such as moving a force application member or driving another desired element in a downhole tool. To move the drive member 710 back to its initial position, members 704 and/or 706 may be expanded so as to hold the drive member 710 in position but allow it to move within the chamber 714. The biasing member 740 will then cause the piston 734 to move downward, causing the fluid in the chamber 732 to move into the chamber 728 via line 730, causing the drive member 710 to move in the direction 719. A control valve 742 in line 730 may be utilized to control the flow of the fluid from the chamber 732 to chamber 728. The surface area of the pistons 716 defines the force exerted by each such piston.

The above-described process may be described as an "inchworm" or "crawl" movement of the drive member 710 along the axis 712. The operation of the piezoelectric members 704, 706 and 708 and the control valve 742 may be controlled by the controller 720, which may be located downhole or at the surface. The stroke of the drive member 710 may be controlled by the amount of the axial expansion of the member 706. Cycling or modulating through the above modes may be used to cause an actuation of a member in a downhole tool, such as a steering member or rib or a drawdown piston, etc.

Thus, in aspects, the actuator arrangement may be placed in a housing so as to allow axial displacement of a drive member of basically unlimited length. Achievable forces of the primary drive unit 702 and the required pressure at the secondary piston 734 can be matched by optimizing the length/diameter ratio of the two pistons. Exerted force may be directly derived from the piezo effect, thus allowing a closed loop control of pressure without additional pressure sensors. Axial force may be applied by a defined friction between the clamping members 704 and 708 and the drive member 710. Further, the surfaces of the components may produce the defined friction used to enable a controlled retraction of the drive member 710 as fluid flows from volume 732 into volume 728. The surface friction may be designed along with biasing member 740 and nozzle 742 to produce optimized control of the drive system 700. The design of drive system 700 also may allow for a simple and efficient inherent overload protection, as the drive member 710 could be controlled to simply slip through the clamps until the excess pressure is released. In such way, a pressure relief valve may be eliminated, at the same time eliminating the need for discontinuous operation to replace leakage volumes lost via the pressure relief valve. A flow restrictor may be placed between first and second cylinder to dampen steep pressure peaks, though this may not be necessary in some embodiments.

For reliable operations of force application members, in power-off situations, controlled release of actuator pressure is desired. In the system of FIG. 7, this would be inherently achieved without the need to drain oil into an additional reservoir, such as via a shut-off valve. The dimensions, expansion characteristics and other properties of the piezoelectric members are chosen so as to provide desired friction factors between the members 704 and 708 and the drive member 710 for reliable operation of the drive unit 702. The friction chosen is sufficient to transmit the required forces. The materials may be matched to allow defined slippage without surface wear. In one aspect, machined micro-ledges on the surface may be provided for desired friction. Also, relatively fast electronic control may be used to release excess pressure quickly by motion of the drive member 710 or release of clamp forces provided by members 704 and 708.

In one aspect, the device shown in FIG. 7 provides a compact actuator arrangement having relatively few components. The device also is inherently resilient to overloads conditions and is not prone to internal fluid leakage and thus not prone to discontinuous operation due to need for refills. Also, no external pressure fluid reservoir is needed—only a compensation volume on low-pressure side is used. Pressurized fluid, as used in the configuration of system of FIG. 7, is generally insensitive to pollution. The complete actuator unit may be built as a sealed unit or a sealed drop-in unit.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure and the following claims.

The invention claimed is:

1. An apparatus to be conveyed into a wellbore, the apparatus comprising:

a housing configured to be conveyed downhole;

a drive member located in the housing; and an actuator configured to actuate linear movement of the drive member to control a downhole device hydraulically via the linear movement of the drive member, the actuator including a first active member coupled to the housing that engages the drive member to bi-directionally hold the drive member in place with respect to the first active member when so engaged and a second active member coupled to the first active member that engages the drive member in alternation with the first active member to move the drive member in a selected direction, wherein the engagement of the actuator to the drive member is controlled by applying an energy to a selected material of the actuator.

2. The apparatus of claim 1, wherein the selected material comprises a piezoelectric material.

3. The apparatus of claim 1, comprising a processor configured to control the device.

4. The apparatus of claim 1, wherein the drive member is configured to control actuation of a steering member of a wellbore tool.

5. The apparatus of claim 1, wherein the actuator comprises an expanding member and a gripping member configured to selectively couple to the drive member, wherein the expanding member and the gripping member each comprise the selected material.

6. An apparatus conveyed into a well borehole for conducting a downhole operation, the apparatus comprising:

a downhole device adapted for conveyance by a work string, the downhole device being used at least in part for conducting the downhole operation; and a magnetostrictive linear actuator coupled to the downhole device to control the downhole device hydraulically via the linear movement, the magnetostrictive actuator including a first active member coupled to a housing that engages the drive member to bi-directionally hold the drive member in place with respect to the first active member when so engaged and a second active member coupled to the first active member that engages the drive member in alternation with the first active member to move the drive member in a selected direction, wherein the magnetostrictive linear actuator includes a support structure to compensate for a borehole parameter.

7. The apparatus of claim 6, wherein the magnetostrictive linear actuator comprises a magnetostrictive material operatively housed within the support structure, the support structure comprising a material having a coefficient of thermal expansion substantially equivalent to the magnetostrictive material.

8. The apparatus of claim 6, wherein the magnetostrictive linear actuator comprises a magnetostrictive material operatively housed within the support structure, the support structure comprising alloyed materials, each of the materials having a different coefficient of thermal expansion, the alloyed materials having an effective coefficient of thermal expansion substantially equivalent to the magnetostrictive material.

9. The apparatus of claim 6, wherein the support structure comprises a ceramic material.

10. The apparatus of claim 6, wherein the support structure comprises a pressurized container pressurized to a surface atmospheric pressure.

11. The apparatus of claim 6, wherein the support structure comprises a dewars cooling device, the magnetostrictive linear actuator being housed within the dewars cooling device, the mechanically-actuated device being located outside the dewars, the magnetostrictive linear actuator including an actuating rod extending from within the dewars to actuate the mechanically-actuated device.

12. The apparatus of claim 6, wherein the support structure comprises a structural member and an active cooling device cooling the structural member.

13. The apparatus of claim 12, wherein the active cooling device includes a thermoelectric cooling element.

14. A method of conducting an operation in a well borehole, the method comprising:

conveying a work string into the borehole;

conducting the operation using a downhole device coupled to the work string;

selectively actuating the downhole device using a magnetostrictive linear actuator coupled to a drive member of the downhole device to control the downhole device hydraulically via a linear movement at the downhole device, wherein the magnetostrictive linear actuator includes a first active member coupled to a housing that bi-directionally engages the drive member to hold the drive member in place with respect to the first active member when so engaged and a second active member coupled to the first active member that engages the drive member in alternation with the first active member to move the drive member in a selected direction; and compensating for a borehole parameter using a support structure coupled to the magnetostrictive linear actuator, the support structure being adapted to compensate for the borehole parameter.

15. The method of claim 14, wherein the borehole parameter is temperature, the magnetostrictive linear actuator including a magnetistrictive material operatively housed within the support structure, the support structure comprising a material having a coefficient of thermal expansion substantially equivalent to the magnetostrictive material.

16. The method of claim 14, wherein the borehole parameter is temperature, the magnetostrictive linear actuator including a magnetostrictive material operatively housed within the support structure, the support structure comprising alloyed materials, each of the materials having a different coefficient of thermal expansion, the alloyed materials having an effective coefficient of thermal expansion substantially equivalent to the magnetostrictive material.

17. The method of claim 14, wherein the support structure comprises a ceramic material.

18. The method of claim 14, wherein the support structure comprises a pressurized container pressurized to a surface atmospheric pressure.

19. The method of claim 14, wherein the support structure comprises a dewars cooling device, the magnetostrictive linear actuator being housed within the dewars cooling device, the mechanically-actuated device being located outside the dewars, the magnetostrictive linear actuator including an actuating rod extending from within the dewars to actuate the mechanically-actuated device.

20. The method of claim 14, wherein the support structure comprises a structural member and an active cooling device, the compensating further comprising cooling the magnetostrictive linear actuator using the active cooling device.

21. The method of claim 20, wherein the active cooling device includes a thermoelectric cooling element.

* * * * *